US010514037B2

(12) United States Patent
Sadakata et al.

(10) Patent No.: US 10,514,037 B2
(45) Date of Patent: Dec. 24, 2019

(54) LIQUID FEEDING TYPE SCREW COMPRESSOR

(71) Applicant: Hitachi Industrial Equipment Systems Co., Ltd., Chiyoda-ku, Tokyo (JP)

(72) Inventors: Kosuke Sadakata, Tokyo (JP); Hitoshi Nishimura, Tokyo (JP); Toshikazu Harashima, Tokyo (JP); Kentaro Yamamoto, Tokyo (JP); Takeshi Tsuchiya, Tokyo (JP); Kotaro Chiba, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 180 days.

(21) Appl. No.: 15/558,653

(22) PCT Filed: Mar. 28, 2016

(86) PCT No.: PCT/JP2016/059904
§ 371 (c)(1),
(2) Date: Sep. 15, 2017

(87) PCT Pub. No.: WO2016/158854
PCT Pub. Date: Oct. 6, 2016

(65) Prior Publication Data

US 2018/0106254 A1 Apr. 19, 2018

(30) Foreign Application Priority Data

Mar. 31, 2015 (WO) ..... PCT/JP2015/060242

(51) Int. Cl.
*F04C 29/02* (2006.01)
*F04C 18/16* (2006.01)
(Continued)

(52) U.S. Cl.
CPC ..... *F04C 29/026* (2013.01); *F04C 18/16* (2013.01); *F04C 2240/20* (2013.01); *F04C 2240/30* (2013.01)

(58) Field of Classification Search
CPC ..... F04C 29/026; F04C 18/16; F01C 21/10; F25B 1/047; F25B 31/002
(Continued)

(56) References Cited

U.S. PATENT DOCUMENTS 2,620,124 A * 12/1952 Brill ..... F04C 18/16 418/2
3,825,372 A * 7/1974 Lundberg ..... F04C 29/026 417/321
(Continued)

FOREIGN PATENT DOCUMENTS

CN 201474972 U 5/2010
CN 104019037 A 9/2014
(Continued)

OTHER PUBLICATIONS

International Preliminary Report on Patentability (PCT/IB/338 & PCT/IB/373) issued in PCT Application No. PCT/JP2016/059904 dated Oct. 12, 2017, including English translation of document C2 (Japanese-language Written Opinion (PCT/ISA/237)) previously filed on Sep. 15, 2017 (eight pages).
(Continued)

*Primary Examiner* — Deming Wan
(74) *Attorney, Agent, or Firm* — Crowell & Moring LLP

(57) ABSTRACT

There is provided a liquid feeding type screw compressor that can reduce size and weight and improve vibration insulation and sound insulation. A liquid feeding type screw compressor includes as components: a compressor main body; a motor driving the compressor main body; and a gas-liquid separator separating a liquid from a compressed
(Continued)

air discharged from the compressor main body. The motor is arranged above the compressor main body. The gas-liquid separator is arranged below the compressor main body. A compressor main body casing constituting an inner cylindrical space forming a compression operation chamber together with the screw rotor and constituting the contour of the compressor main body and a casing constituting the contour of another component consist of an integrally molded single member.

15 Claims, 20 Drawing Sheets

(51) Int. Cl.
*F25B 1/047* (2006.01)
*F25B 31/00* (2006.01)
*F01C 21/10* (2006.01)

(58) Field of Classification Search
USPC ..... 418/101, 201.1, 97
See application file for complete search history.

(56) References Cited

U.S. PATENT DOCUMENTS

| | | | |
|---|---|---|---|
| 4,091,638 | A | 5/1978 | Mitch |
| 5,697,763 | A | 12/1997 | Kitchener |
| 2002/0067998 | A1 | 6/2002 | Narney, II et al. |

FOREIGN PATENT DOCUMENTS

| | | | | | |
|---|---|---|---|---|---|
| DE | 197 39 279 | A1 | | 3/1999 | |
| GB | 1 003 961 | A | | 9/1965 | |
| GB | 2394009 | A | * | 4/2004 | ..... F04C 23/00 |
| JP | 50-60812 | A | | 5/1975 | |
| JP | 53-75513 | A | | 7/1978 | |
| JP | 59-215986 | A | | 12/1984 | |
| JP | 60-47893 | A | | 3/1985 | |
| JP | 60-111084 | A | | 6/1985 | |
| JP | 3-68585 | U | | 7/1991 | |
| JP | 8-247034 | A | | 9/1996 | |
| JP | 9-504069 | A | | 4/1997 | |
| JP | 2003-83272 | A | | 3/2003 | |
| JP | 2010-65562 | A | | 3/2010 | |

OTHER PUBLICATIONS

Japanese-language Office Action issued in counterpart Japanese Application No. 2017-509974 dated Jul. 3, 2018 with English translation (six (6) pages).
Extended European Search Report issued in counterpart European Application No. 16772735.3 dated Dec. 11, 2018 (11 pages).
Chinese-language Office Action issued in counterpart Chinese Application No. 201680015482.5 dated Aug. 1, 2018 with English translation (14 pages).
International Search Report (PCT/ISA/210) issued in PCT Application No. PCT/JP2016/059904 dated Jun. 28, 2016 with English translation (Four (4) pages).
Japanese-language Written Opinion (PCT/ISA/237) issued in PCT Application No. PCT/JP2016/059904 dated Jun. 28, 2016 (Four (4) pages).
International Search Report (PCT/ISA/210) issued in PCT Application No. PCT/JP2015/060242 dated Jun. 30, 2015 with English translation (Four (4) pages).
Japanese-language Written Opinion (PCT/ISA/237) issued in PCT Application No. PCT/JP2015/060242 dated Jun. 30, 2015 (Four (4) pages).

* cited by examiner

LIQUID FEEDING TYPE SCREW COMPRESSOR

TECHNICAL FIELD

The present invention relates to a liquid feeding type screw compressor supplying a liquid into a compression chamber when, for example, cooling compression heat generated in a compressor main body.

BACKGROUND ART

In recent years, in plants, distributed arrangement of compressors are being promoted, with compressors for various uses being arranged at various locations in the vicinity of the production line. In such a distributed arrangement, the installation space for the individual compressors is limited, so that there is a demand for space saving for the compressors.

Patent Document 1 discloses an example of a technique for reducing the installation space for a compressor. In a rotary compressor system 10 (an oil cooled type screw compressor) shown in FIG. 3 of Patent Document 1, a compressor unit 11 (a compressor main body) is arranged above a pressure container 14 (an oil separator), and besides, a motor 12 is arranged above the compressor unit 11 (compressor main body), thereby achieving a reduction in floor space (installation space).

PRIOR ART DOCUMENT

Patent Document

Patent Document 1: JP-9-504069-A

SUMMARY OF THE INVENTION

Problem to be Solved by the Invention

However, in the compressor system 10 disclosed in FIG. 3 of Patent Document 1, the motor 12 and the compressor unit 11, which are of large weight, are arranged above the pressure container 14, so that the center of gravity is rather high, and there is a fear of the vibration during motor operation being large and the noise attributable thereto being loud.

The present invention has been made in view of the above situation. It is an object of the present invention to provide a liquid feeding type screw compressor that can reduce installation space and improve vibration insulation and sound insulation.

Means for Solving the Problem

To achieve the above object, the construction as described in the appended claims is applied. There is provided a liquid feeding type screw compressor including as components: a compressor main body equipped with a screw rotor; a motor driving the compressor main body; and a gas-liquid separator separating a liquid from a compressed air discharged from the compressor main body. The motor is arranged above the compressor main body. The gas-liquid separator is arranged below the compressor main body. A compressor main body casing constituting an inner cylindrical space forming a compression operation chamber together with the screw rotor and constituting the contour of the compressor main body and a casing constituting the contour of another component consist of an integrally molded single member.

As another construction, there is provided a liquid feeding type screw compressor including as components: a compressor main body equipped with a screw rotor; a motor driving the compressor main body; and a gas-liquid separator separating a liquid from a compressed air discharged from the compressor main body. The motor is arranged above the compressor main body. The gas-liquid separator is arranged below the compressor main body. A compressor main body casing constituting an inner cylindrical space forming a compression operation chamber together with the screw rotor and constituting the contour of the compressor main body has in its outer periphery a rib extending in the vertical direction and a rib extending in the horizontal direction along the outer periphery.

Effect of the Invention

According to an aspect of the present invention, it is possible to reduce the installation space for the liquid feeding type screw compressor, and to improve the vibration insulation and the sound insulation of the liquid feeding type screw compressor.

Other objects and effects of the present invention will become more apparent in the following description.

MODES FOR CARRYING OUT THE INVENTION

Figure 1:
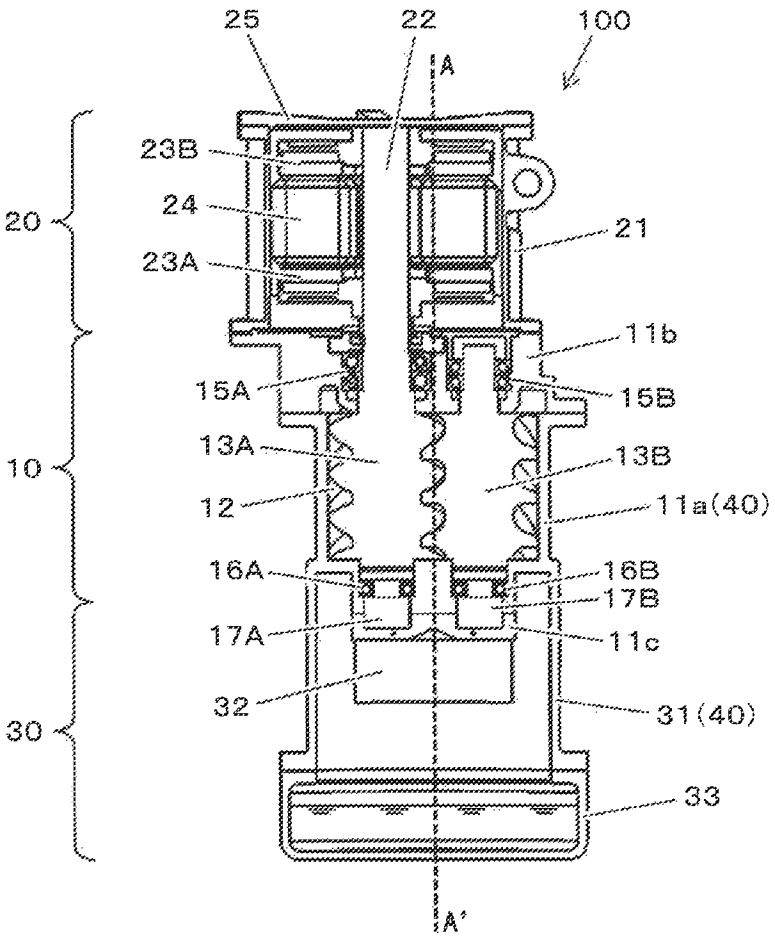
FIG. 1 is a longitudinal sectional view as seen from the front side of an oil cooled type screw compressor according to Embodiment 1 of the present invention.

In the following, embodiments of the present invention will be described with reference to the drawings. In the drawings, the same or equivalent members are indicated by the same reference numerals, and a redundant description thereof will be omitted as appropriate.

Embodiment 1

Figure 2:
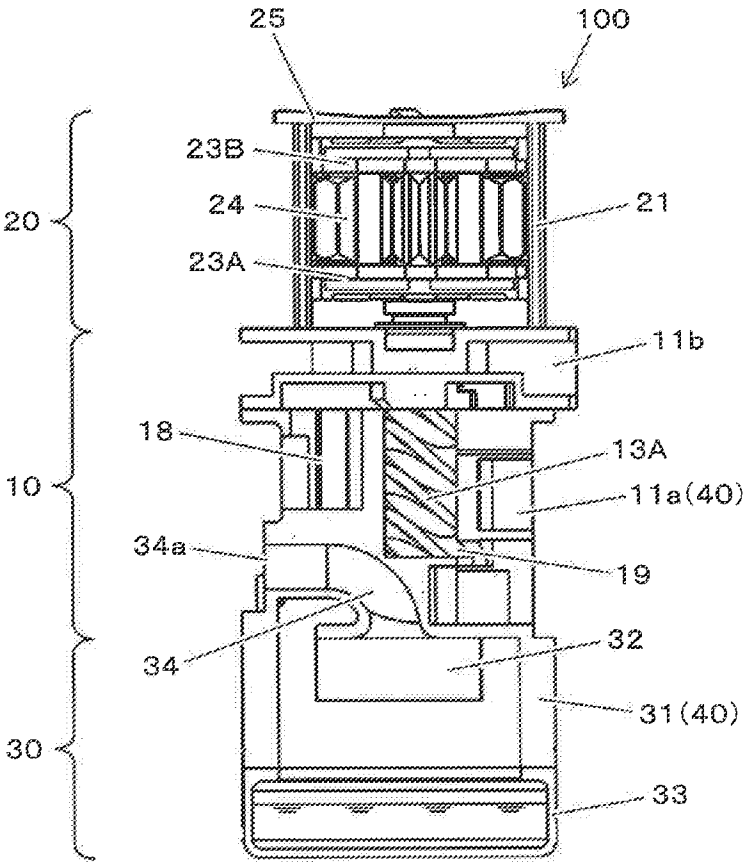
FIG. 2 is a longitudinal sectional view as seen from a side of the oil cooled type screw compressor according to Embodiment 1 of the present invention.

FIG. 1 is a longitudinal sectional view as seen from the front side of an oil cooled type screw compressor according to Embodiment 1 of the present invention, and FIG. 2 is a side longitudinal sectional view taken along line A-A' of FIG. 1. In an oil cooled type screw compressor, oil is supplied to a compression operation chamber in order to cool the compressed air, to lubricate screw rotors, and to seal a gap between the screw rotors and a gap in the compression operation chamber. The present invention is also applicable to a case where water or the like is supplied instead of oil.

An oil cooled type screw compressor 100 includes, as components, a compressor main body 10, a motor 20 driving the compressor main body 10, and an oil separator 30 as a gas-liquid separator primarily separating the oil from the compressed air discharged from the compressor main body 10. The motor 20 is arranged above the compressor main body 10 such that a shaft 22 of the motor 20 described below is oriented in the vertical direction, and the oil separator 30 is arranged below the compressor main body 10.

The compressor main body 10 is equipped with a compressor main body casing 11*a* constituting the contour, a male rotor 13A and a female rotor 13B arranged so as to be in mesh with each other in a rotor accommodating chamber 12 formed inside the compressor main body casing 11*a*, a suction side casing 11*b* connected airtightly to the suction side of the compressor main body casing 11*a* with a flange or the like, and a discharge side cover 11*c* connected airtightly to the discharge side of the compressor main body casing 11*a*. The compressor main body casing 11*a* is a single molded member having the rotor accommodating chamber 12 and the outer surface of the compressor main body, and can be obtained by a mold, a three-dimensional shaping machine or the like. Further, in the present embodiment, the compressor main body casing 11*a* and an outer cylinder casing 31 of the oil separator 30 described below are also formed as an integrally-molded single member. In the following, the compressor main body casing 11*a* and the oil separator 30 thus integrally molded may be generally referred to as an "integral type casing (40)."

The suction side end portions of the male rotor 13A and the female rotor 13B are respectively rotatably supported by suction side bearings 15A and 15B provided in a suction side casing 11*b*. The discharge side end portions of the male rotor 13A and the female rotor 13B are respectively rotatably supported by discharge side bearings 16A and 16B arranged on the discharge side of the compressor main body casing 11*a*. Between the discharge side end portions of the male rotor 13A and the female rotor 13B and the discharge side cover 11*c*, oil sumps 17A and 17B are respectively arranged.

As shown in FIG. 2, the compressor main body 10 has, in the side surface portion on the suction side, a suction chamber 18 formed by the compressor main body casing 11*a* and the suction side casing 11*b*. The suction chamber 18 communicates with the suction side of the rotor accommodating chamber 12. Air for compression is guided to the suction chamber 18 via a suction communication line which is not shown. The compressor main body casing 11*a* has, in the side surface portion on the discharge side, a discharge port 19 communicating with the discharge side of the rotor accommodating chamber 12.

The male rotor 13A is rotationally driven by a motor 20, and rotates in mesh with the female rotor 13B. The air for compression guided to the suction chamber 18 is sucked into the rotor accommodating chamber 12 by the male rotor 13A and the female rotor 13B rotating in mesh with each other. The air sucked into the rotor accommodating chamber 12 is compressed by a compression operation chamber formed by the male rotor 13A and the female rotor 13B meshing with each other. In this air compression process, compression heat is generated. To dissipate this compression heat, and besides, to lubricate between the male rotor 13A, the female rotor 13B, and the inner wall of the rotor accommodating chamber 12, oil (lubricant) is injected onto the suction side bearings 15A, 15B, etc. The compressed air compressed in the compression operation chamber is discharged from the discharge port 19 together with the oil (lubricant), and flows into the oil separator 30.

The motor 20 is an axial gap type motor, and is equipped with a motor casing 21 having an inner cylinder portion constituting the contour and supporting the stator 20, a shaft 22 integrally connected to the suction side of the male rotor 13A, an output side motor rotor 23A mounted to the output side of the shaft 22, an anti-output side motor rotor 23B mounted to the anti-output side of the shaft 22, and a stator 24 fixed to the inner peripheral surface of the motor casing 21 and arranged so as to be opposite each of the motor rotor 23A and 23B in the axial direction. Although in the present embodiment a 1-stator/2-rotor type construction is adopted by way of example, the invention is not restricted to this construction. The number of stators and that of rotors may be selected arbitrarily.

The output side of the motor casing 21 is connected airtightly to the suction side casing 11*b* of the compressor main body 10 with a flange or the like, and the anti-output side of the motor casing 21 is connected airtightly to an end bracket 25 with a flange or the like. In this way, the suction side casing 11*b* is connected to the output side of the motor casing 21, whereby there is no need to provide a bracket on the output side of the motor 20. Further, the shaft 22 is formed integrally with the suction side end portion of the male rotor 13A supported by the compressor main body 10, whereby there is no need to provide a bearing inside the motor 20, making it possible to reduce the size and weight of the motor 20. The present invention is not restricted to the above construction but allows adoption of a construction in which the anti-output side end portion of the shaft 20 is pivotably supported by a bearing.

The stator 24 is configured by a plurality of cores annularly arranged so as to be at a predetermined interval from the outer peripheral surface of the shaft 22, and each of the plurality of cores has an exciting coil. Due to an electric current flowing through the coils, a magnetic flux is generated in the cores, forming a magnetic field looped in the axial direction. The output side motor rotor 23A supports a plurality of magnets at a predetermined interval from the output side end surface of the stator 24. The anti-output side motor rotor 23B supports a plurality of magnets at a predetermined interval from the anti-output side end surface of the stator 24. Due to the interaction between the magnetic field formed by the magnets of the motor rotors 23A and 23B and the magnetic field formed by the stator 24, the motor rotors 23A and 23B and the shaft 22 are rotationally driven.

The oil separator 30 is equipped with an outer cylinder casing 31 constituting the contour, an inner cylinder 32 provided above the outer cylinder casing 31 so as to be concentric with the outer cylinder casing 31, and an oil storage portion 33 connected airtightly to the lower portion of the outer cylinder casing 31 with a flange or the like. As described above, the outer cylinder casing 31 is molded integrally with the compressor main body casing 11*a*, and constitutes an integral type casing 40 as a single member.

The compressed air having flowed into the oil separator 30 from the compressor main body 10 flows in the circumferential direction through the space defined between the inner peripheral surface of the outer cylinder casing 31 and the outer peripheral surface of the inner cylinder 32, thereby being subject to a centrifugal force, etc. Due to the difference in specific weight between the compressed air and the oil, the oil is separated toward the outer cylinder casing 31 side, and the compressed air is separated toward the inner cylinder 32 side. The oil primarily separated through this centrifugal separation falls along the inner peripheral surface of the outer cylinder casing 31, and is stored in the oil storage portion 33. Due to the difference between the pressure in the oil separator 30 and the pressure in the compression operation chamber of the compressor main body 10, the oil stored in the oil storage portion 33 is returned to the suction side of the compressor main body 10 via oil return piping (not shown). The compressed air after the primary separation of the oil flows into the inner cylinder 32 from a lower opening of the inner cylinder 32, and is guided to an oil separation filter (not shown) via discharge piping 34 connected to an upper opening of the inner cylinder 32 and a discharge port 34*a* to undergo secondary separation.

In the oil cooled type screw compressor 100 according to the present embodiment, the compressor main body 10 is arranged above the oil separator 30, and the motor 20 is arranged above the compressor main body 10, whereby it is possible to reduce installation space.

Further, the oil cooled type screw compressor 100 is equipped with the integral type casing 40 obtained by integrally molding the compressor main body casing 11*a* and the outer cylinder casing 31 of the oil separator 30, whereby the casing rigidity of the oil cooled type screw compressor 100 is enhanced and the vibration insulation and the sound insulation of the oil cooled type screw compressor 100 are improved.

Further, due to the integral molding of the compressor main body casing 11*a* and the outer cylinder casing 31, the number of elements is reduced and there is no need to provide a flange or the like for connecting the compressor main body casing 11*a* and the outer cylinder casing 31, with the result that the assembly efficiency of the oil cooled type screw compressor 100 is improved and the size and weight of the oil cooled type screw compressor 100 can be reduced.

(Modification)

Figure 3:
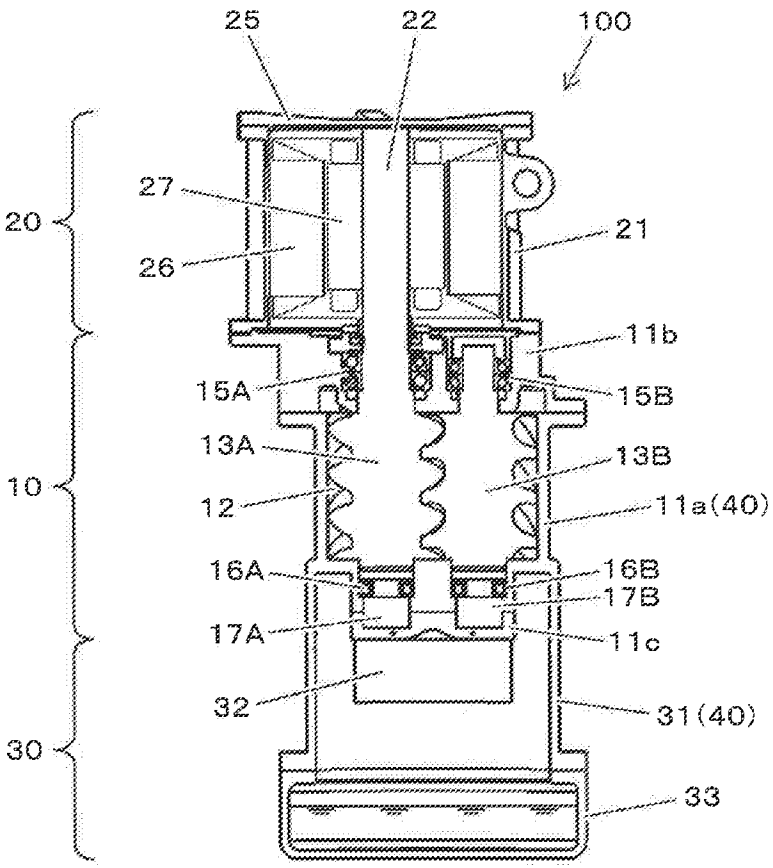
FIG. 3 is a longitudinal sectional view as seen from the front side of an oil cooled type screw compressor according to a modification of Embodiment 1 of the present invention.

Although in the construction example shown in FIG. 1 an axial gap type motor is used as the motor 20, the invention is not restricted to this construction. As shown in FIG. 3, a radial gap type motor may be adopted in which a stator 26 and a motor rotor 27 are arranged so as to be opposite each other in the radial direction.

Embodiment 2

Figure 4:
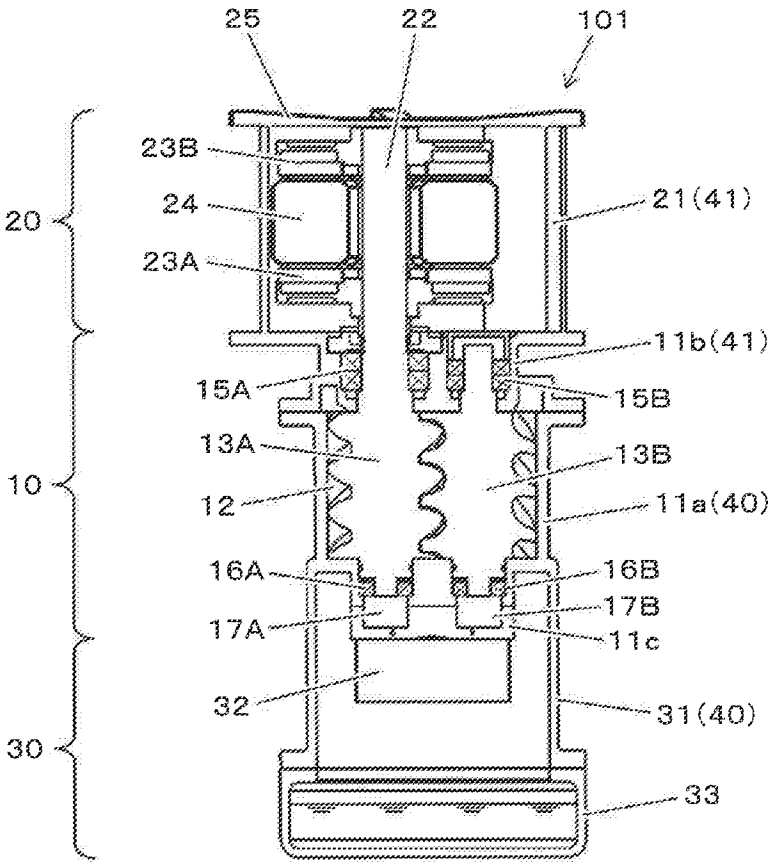
FIG. 4 is a longitudinal sectional view as seen from the front side of an oil cooled type screw compressor according to Embodiment 2 of the present invention.

FIG. 4 is a longitudinal sectional view as seen from the front side of an oil cooled type screw compressor according to Embodiment 2 of the present invention. As compared with the oil cooled type screw compressor 100 according to Embodiment 1 (see FIG. 1), the oil cooled type screw compressor 101 according to the present embodiment differs in that it is equipped with an integral type casing 41 as a single member obtained by integrally molding a motor casing 21 and a suction side casing 11*b*.

In the oil cooled type screw compressor 101 according to the present embodiment, it is possible to attain the same effects as those of the oil cooled type screw compressor 100 according to Embodiment 1 (see FIG. 1), and there is provided the integral type casing 41 obtained by integrally molding the motor casing 21 constituting the contour of the motor 20 and the suction side casing 11*b* constituting the contour of the compressor main body 10, whereby the casing rigidity of the oil cooled type screw compressor 101 as a whole is enhanced, and the vibration insulation and the sound insulation of the oil cooled type screw compressor 101 are further improved.

Further, due to the integral molding of the motor casing 21 and the suction side casing 11*b*, the number of elements is reduced and there is no need to provide a flange or the like for connecting the motor casing 21 and the suction side casing 33, with the result that the assembly efficiency of the oil cooled type screw compressor 101 is further improved, and that it is possible to further reduce the size and weight of the oil cooled type screw compressor 101.

Embodiment 3

Figure 5:
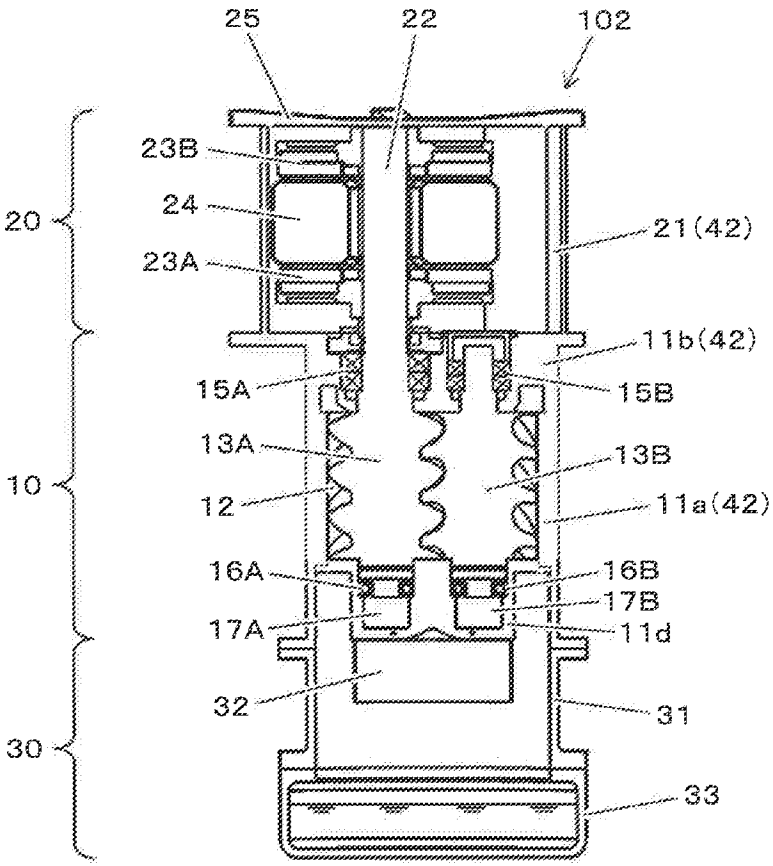
FIG. 5 is a longitudinal sectional view as seen from the front side of an oil cooled type screw compressor according to Embodiment 3 of the present invention.

FIG. 5 is a longitudinal sectional view as seen from the front side of an oil cooled type screw compressor according to Embodiment 3 of the present invention. The oil cooled type screw compressor 102 according to the present embodiment is equipped with an integral type casing 42 as a single member obtained by integrally molding the motor casing 21, the suction side casing 11*b*, and the compressor main body casing 11*a*. The integral type casing 42 and the outer cylinder casing 31 of the oil separator 30 are connected together airtightly with a flange or the like.

In the oil cooled type screw compressor 102 according to the present embodiment, due to the integral molding of the suction side casing 11*b* and the compressor main body casing 11*a*, the rotors 13A and 13B cannot be accommodated in the rotor accommodating chamber 12 from the suction side of the compressor main body 10. In view of this, in order that the male rotor 13A and the female rotor 13B can be accommodated in the rotor accommodating chamber 12 from the suction side of the compressor main body 10, a discharge side cover 11*d* formed so as to close the entire discharge side of the rotor accommodating chamber 12 is mounted airtightly and detachably, and discharge side bearings 16A and 16B are arranged on this discharge side cover 11*d*.

As in Embodiments 1 and 2, in the oil cooled type screw compressor 102 according to the present embodiment, the compressor main body 10 is arranged above the oil separator 30, and the motor 20 is arranged above the compressor main body 10, whereby it is possible to reduce installation space.

Further, there is provided the integral type casing 42 obtained by integrally molding the motor casing 21 constituting the contour of the motor 20, and the suction side casing 11*b* and the compressor main body casing 11*a* constituting the contour of the compressor main body 10, whereby the casing rigidity of the oil cooled type screw compressor 102 as a whole is enhanced, and the vibration insulation and the sound insulation of the oil cooled type screw compressor 100 are improved.

Further, due to the integral molding of the motor casing 21, the suction side casing 11*b*, and the compressor main body casing 11*a*, the number of elements is reduced, and there is no need to provide a flange or the like for connecting the motor casing 21 and the suction side casing 11*b* and a flange or the like for connecting the suction side casing 11*b* and the compressor main body casing 11*a*, whereby the assembly efficiency of the oil cooled type screw compressor 102 is improved, and it is possible to reduce the size and weight of the oil cooled type screw compressor 102.

(Modification)

While in FIG. 5 a construction is shown in which the motor casing 21, the suction side casing 11*b*, and the compressor main body casing 11*a* are integrally molded, a construction may also adopted in which only the motor casing 21 constituting the contour of the motor 20 and the suction side casing 11*b* constituting the contour of the compressor main body 10 are integrally molded. In this case also, the casing rigidity of the oil cooled type screw compressor 101 as a whole is enhanced, and the vibration insulation and the sound insulation of the oil cooled type screw compressor 101 are improved.

Embodiment 4

Figure 6:
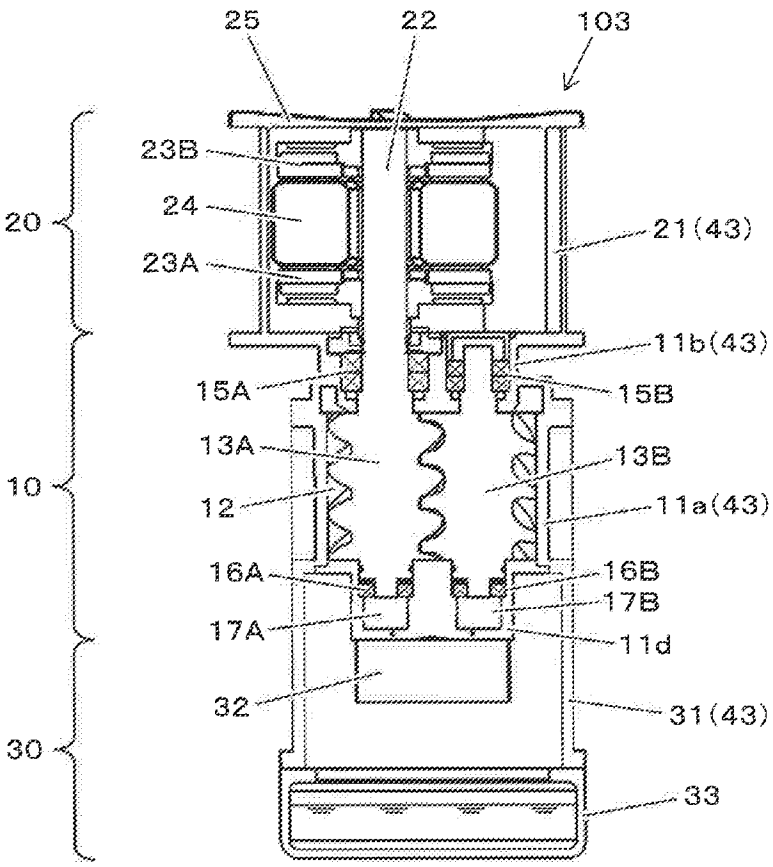
FIG. 6 is a longitudinal sectional view as seen from the front side of an oil cooled type screw compressor according to Embodiment 4 of the present invention.

FIG. 6 is a longitudinal sectional view as seen from the front side of an oil cooled type screw compressor according to Embodiment 4 of the present invention. The oil cooled type screw compressor 103 according to the present embodiment is equipped with an integral type casing 43 as a single member obtained by integrally molding the motor casing 21, the suction side casing 11*b*, the compressor main body casing 11*a*, and the outer cylinder casing 31. The integral type casing 43 and the oil storage portion 33 are connected to each other airtightly with a flange or the like.

As in the case of the oil cooled type screw compressor 102 (see FIG. 5) according to Embodiment 3, in the oil cooled type screw compressor 103 of the present embodiment, the suction side casing 11*b* and the compressor main body casing 11*a* are integrally molded, so that the male rotor 13A and the female rotor 13B cannot be accommodated in the rotor accommodating chamber 12 from the suction side of the compressor main body 10. In view of this, in order that the male rotor 13A and the female rotor 13B can be accommodated in the rotor accommodating chamber 12 from the suction side of the compressor main body 10, the discharge side cover 11*d* formed so as to close the entire discharge side of the rotor accommodating chamber 12 is mounted airtightly and detachably, and the discharge side bearings 16A and 16B are arranged on this discharge side cover 11*d*.

As in Embodiments 1 through 3, in the oil cooled type screw compressor 103 according to the present embodiment, the compressor main body 10 is arranged above the oil separator 30, and the motor 20 is arranged above the compressor main body 10, whereby it is possible to reduce installation space.

Further, there is provided the integral type casing 43 obtained by integrally molding the motor casing 21 constituting the contour of the motor 20, and the suction side casing 11*b* and the compressor main body casing 11*a* constituting the contour of the compressor main body 10, and the outer cylinder casing 31 constituting the contour of the oil separator 30, whereby the casing rigidity of the oil cooled type screw compressor 103 as a whole is enhanced, and the vibration insulation and the sound insulation of the oil cooled type screw compressor 103 are improved.

Further, there is no need to provide a flange or the like for connecting the motor casing 21 and the suction side casing 11*b*, a flange or the like for connecting the suction side casing 11*b* and the compressor main body casing 11*a*, and a flange or the like for connecting the compressor main body casing 11*a* and the outer cylinder casing 31, whereby the assembly efficiency of the oil cooled type screw compressor 102 is improved, and it is possible to reduce the size and weight of the oil cooled type screw compressor 103.

Embodiment 5

Figure 7:
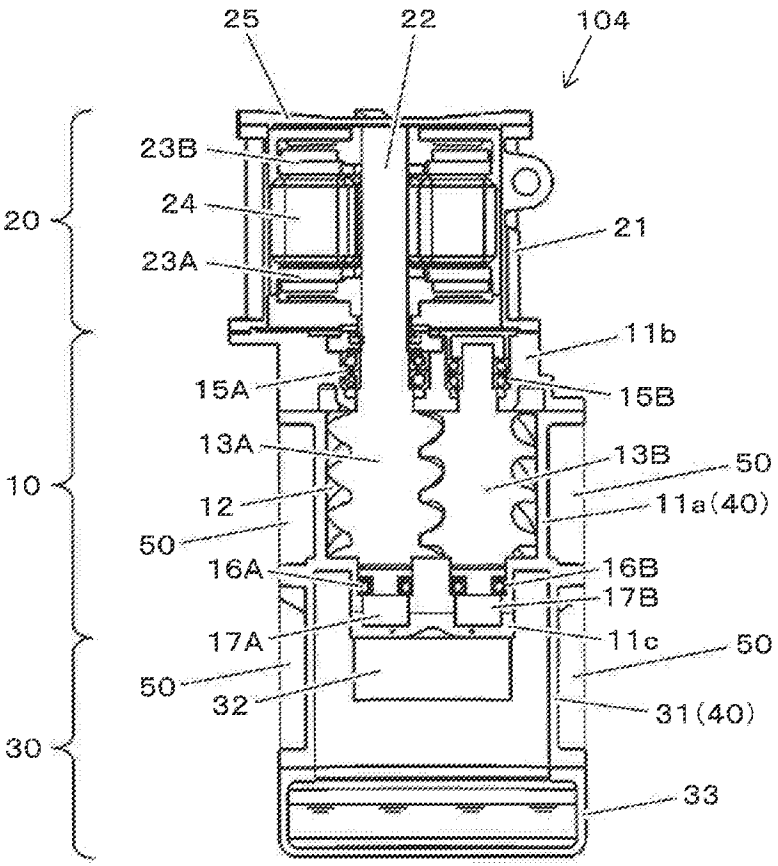
FIG. 7 is a longitudinal sectional view as seen from the front side of an oil cooled type screw compressor according to Embodiment 5 of the present invention.

FIG. 7 is a longitudinal sectional view as seen from the front side of an oil cooled type screw compressor according to Embodiment 5 of the present invention. As compared with the oil cooled type screw compressor 100 according to Embodiment 1 (see FIG. 1), the oil cooled type screw compressor 104 according to the present embodiment differs in that it has one or a plurality of vertically extending ribs 50 on the outer peripheral surface of the integral type casing 40 as a single member obtained by integrally molding the compressor main body casing 11*a* and the outer cylinder casing 31 (in the present embodiment, a plurality of ribs are provided). In the integral type casing 40, the ribs 50 extend over all or a part of the vertical length of the compressor main body casing 11*a* and the outer cylinder casing 31. Alternatively, the ribs may extend astride all or a part of the vertical length of both casings. The ribs 50 are formed through integral molding simultaneously with the integral molding of the compressor main body casing 11*a* and the outer cylinder casing 31. They may also be installed on the integral type casing 40 afterwards through welding, bonding or the like.

In the oil cooled type screw compressor 104 according to the present embodiment, it is possible to attain the same effects as those of the oil cooled type screw compressor 100 according to Embodiment 1, and a plurality of ribs 50 are provided on the outer peripheral surface of the integral type casing 40, whereby the rigidity of the integral type casing 40 is enhanced, and the vibration insulation and the sound insulation of the oil cooled type screw compressor 104 are further improved.

Further, due to the provision of a plurality of ribs 50 on the outer peripheral portion of the integral type casing 40, the surface area of the integral type casing 40 is increased, so that the heat radiation of the oil cooled type screw compressor 104 is improved.

(Modification)

Figure 8:
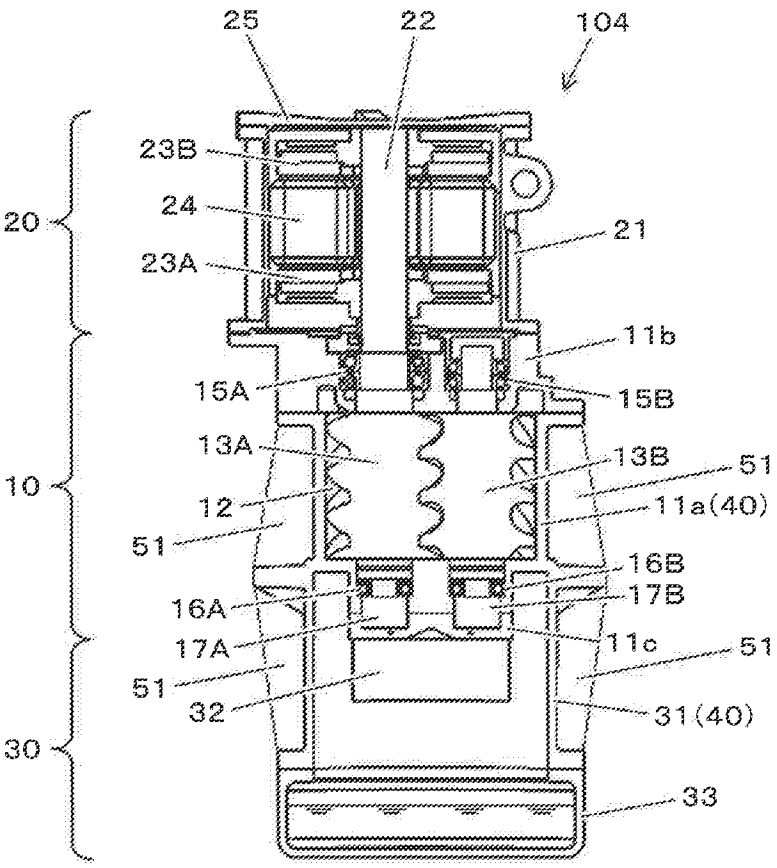
FIG. 8 is a longitudinal sectional view as seen from the front side of an oil cooled type screw compressor according to a modification of Embodiment 5 of the present invention.

The ribs 50 shown in FIG. 7 is just one example, and the number, configuration, arrangement, etc. of the ribs 50 can be changed as appropriate. For example, as shown in FIG. 8, there may be provided a plurality of ribs 51 formed such that their radial dimensions increase as they extend toward the portion near the discharge side of the compressor main body 10. As a result, the heat near the discharge side bearings 16A and 16B of the compressor main body 10, which attains particularly high temperature, is efficiently dissipated, so that the heat radiation of the oil cooled type screw compressor 104 is further improved. Further, the radial dimension of the ribs 50 near the discharge side of the compressor main body 10, which attains the highest internal pressure, is the largest, so that it is possible to enhance the rigidity and further improve the vibration insulation and the sound insulation.

Embodiment 6

Figure 9:
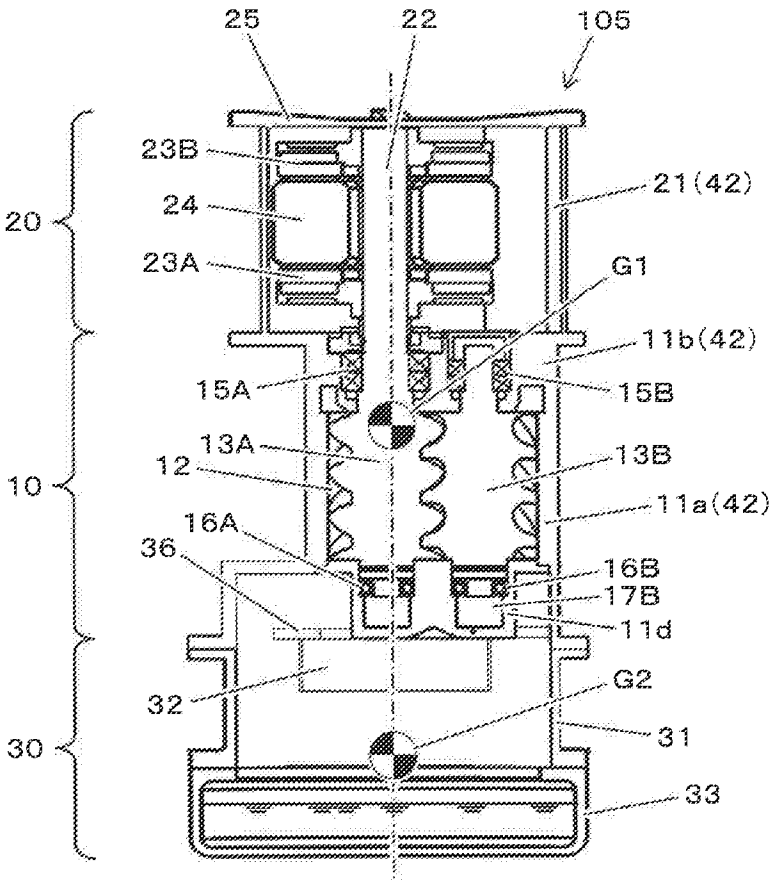
FIG. 9 is a longitudinal sectional view as seen from the front side of an oil cooled type screw compressor according to Embodiment 6 of the present invention.

FIG. 9 is a longitudinal sectional view as seen from the front side of an oil cooled type screw compressor according to Embodiment 6 of the present invention. As compared with the oil cooled type screw compressor 102 (see FIG. 5) according to Embodiment 4, the oil cooled type screw compressor 105 according to the present embodiment differs in that the radial dimension of the oil separator 30 is enlarged such that the synthetic center of gravity G1 of the motor 20 and the compressor main body 10 molded into the integral type casing 43, and the center of gravity G2 of the oil separator 30 are positioned on the same vertical axis.

Figure 10:
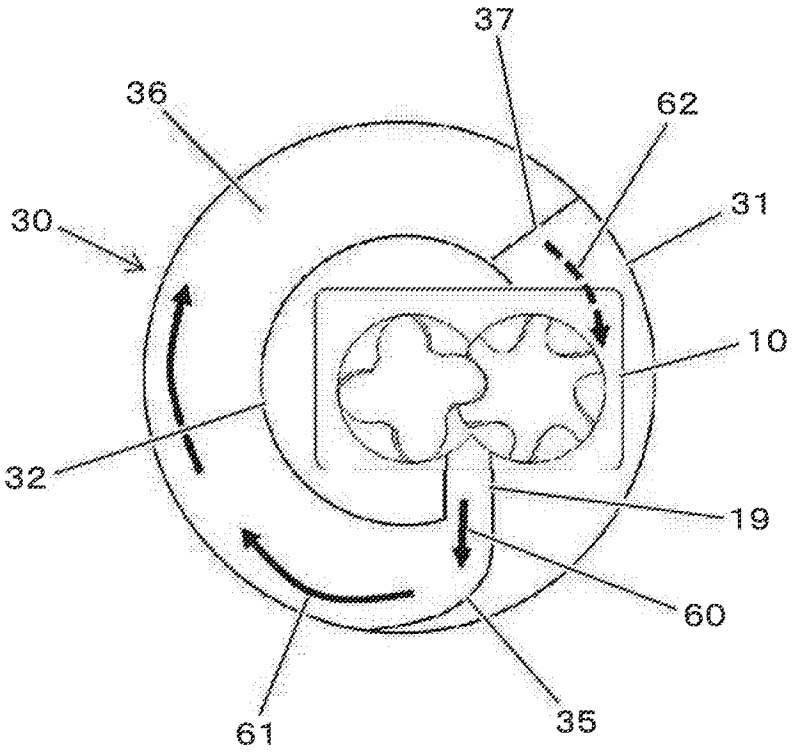
FIG. 10 is a diagram illustrating vertically from above the positional relationship between a compressor main body and an oil separator of the oil cooled type screw compressor according to Embodiment 6 of the present invention.

FIG. 10 is a diagram illustrating vertically from above the positional relationship between a compressor main body 10 and the oil separator 30 of an oil cooled type screw compressor 105 according to the present embodiment. In FIG. 10, the oil separator 30 consists of a plate-like member having a curvature around the vertical axis, and is equipped with a guide 35 smoothly connecting the discharge port 19 and the inner peripheral surface of the outer cylinder casing 31, and a slope 36 provided substantially horizontally around approximately half the circumference between the inner peripheral surface of the outer cylinder casing 31 and the outer peripheral surface of the inner cylinder 32.

A compressed air flow 60 discharged from the discharge port 19 of the compressor main body 10 is deflected by the guide 35 toward the peripheral direction of the inner peripheral surface of the outer cylinder casing 31, and is deflected by the slope 36 toward the horizontal direction. The compressed air flow 61 deflected by the guide 35 and the slope 36 passes approximately half the circumference along the inner peripheral surface of the outer cylinder casing 31. After it has reached a terminal end portion 37 of the slope 36, it flows into the space between the outer cylinder casing 31 and the inner cylinder 32 below the compressor main body 10, and becomes a flow 62 along the inner peripheral surface of the outer cylinder casing 31. The compressed air flow 62 is subjected to the centrifugal force by flowing through the space between the outer cylinder casing 31 and the inner cylinder 32 in the circumferential direction, and due to the difference in specific weight between the compressed air and the oil, the oil is separated toward the outer cylinder casing 31 side, and the compressed air is separated toward the inner cylinder 32 side by the centrifugal force. The oil that has been primarily separated by the centrifugal force falls along the inner peripheral surface of the outer cylinder casing 31 to be stored in the oil storage portion 33 (see FIG. 9). After the primary separation of the oil, the compressed air flows into the inner cylinder 32 from the lower opening of the inner cylinder 32, and is guided to an oil separation filter (not shown) via the discharge piping 34 (see FIG. 2) connected to the upper opening of the inner cylinder 32 to undergo secondary separation.

In the oil cooled type screw compressor 105 according to the present embodiment, it is possible to attain the same effects as those of the oil cooled type screw compressor 102 according to Embodiment 4 (see FIG. 5). At the same time, the synthetic center of gravity G1 of the motor 20 and the compressor main body 10 integrated by the integral type casing 42 and the center of gravity G2 of the oil separator 30 are positioned on the same vertical axis, so that it is possible to install the oil cooled type screw compressor 105 stably, and the vibration insulation and the sound insulation of the oil cooled type screw compressor 105 are further improved.

Further, the compressor main body 10 is arranged away from the center of gravity of the outer cylinder casing 31, whereby the angle made by the orientation of the discharge port 60 with respect to the peripheral direction of the inner peripheral surface of the outer cylinder casing 31 can be made smaller as compared with the case where the compressor main body 10 is arranged at the center of gravity of the outer cylinder casing 31. As a result, it is possible to suppress a reduction in speed until the compressed air flow 60 discharged from the discharge port 19 changes into the flow 61 along the inner peripheral surface of the outer cylinder casing 31, making it possible to improve the oil separation performance of the oil separator 30.

(Modification)

Figure 11:
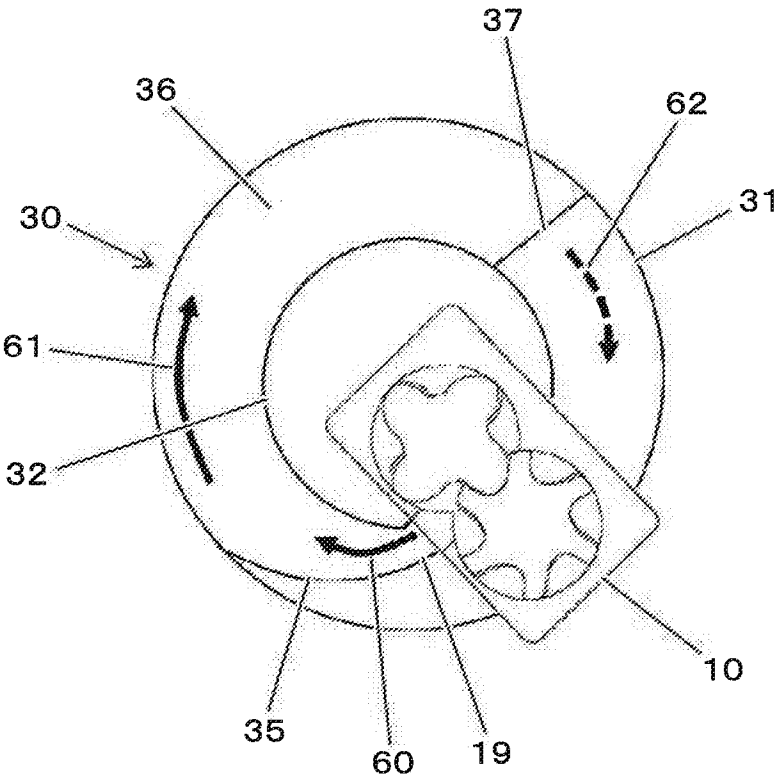
FIG. 11 is a diagram illustrating vertically from above the positional relationship between a compressor main body and an oil separator of the oil cooled type screw compressor according to a modification of Embodiment 6 of the present invention.

The positional relationship between the compressor main body 10 and the oil separator 30 shown in FIG. 10 is just one example, and the arrangement of the compressor main body 10 with respect to the oil separator 30 can be changed as appropriate. For example, it is not always necessary for the synthetic center of gravity G1 of the compressor main body 10 and the center of gravity G2 of the oil separator 30 to be positioned on the same vertical axis. As shown in FIG. 11, the compressor main body 10 may be arranged such that the orientation of the discharge port 19 is as much as possible along the inner peripheral surface of the outer cylinder casing 31. As a result, the angle made by the orientation of the discharge port 60 with respect to the peripheral direction of the inner peripheral surface of the outer cylinder casing 31 is further diminished, so that it is possible to further suppress the reduction in speed until the compressed air flow 60 discharged from the discharge port 19 changes into the flow 61 along the inner peripheral surface of the outer cylinder casing 31, making it possible to further improve the oil separation performance of the oil separator 30.

Embodiment 7

Although in the above-described embodiments two of the following members: the motor casing 21, the suction side casing 11*b*, the compressor main body casing 11*a*, and the outer cylinder casing 31, are formed as an integrally-formed single member, in some cases, it is possible to enjoy a merit in terms of assembly efficiency and productivity even if the above-mentioned members are all formed as independent members and connected together by bolts or the like (divisional construction). In the present embodiment described below, an enhancement in rigidity and an improvement in sound insulation and vibration insulation are achieved in the case where each casing is individually constructed.

Figure 12:
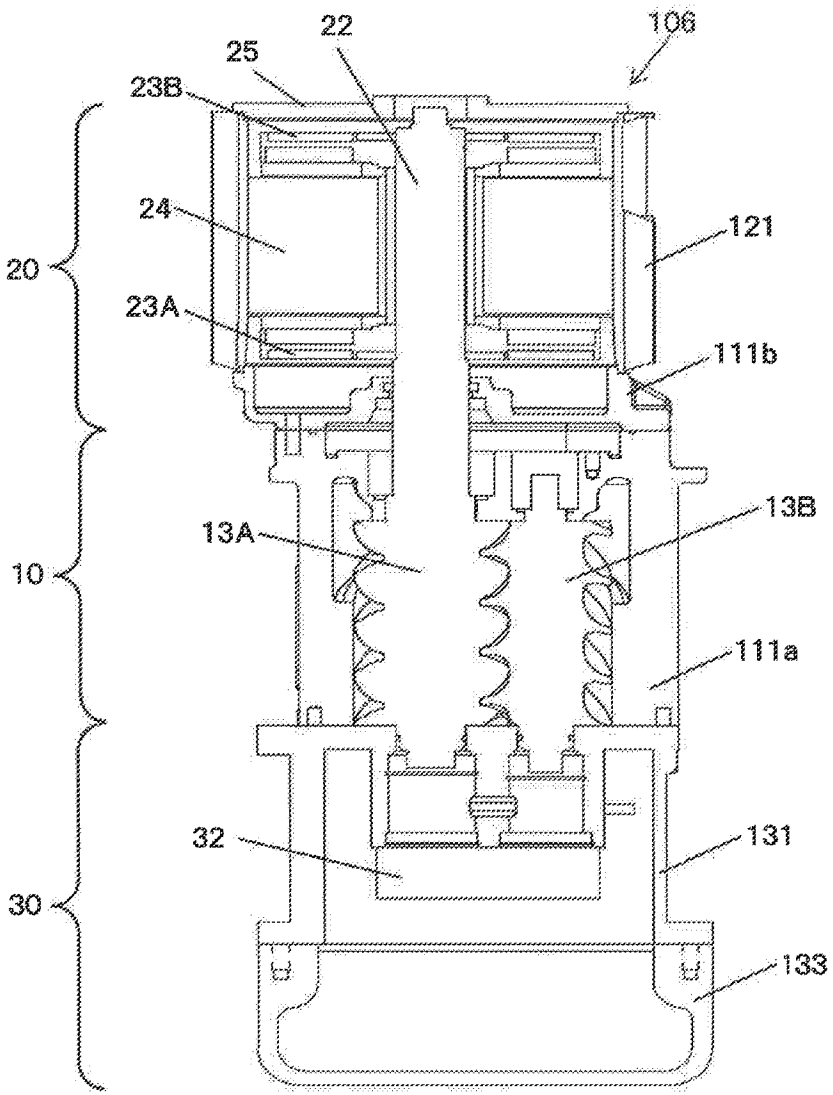
FIG. 12 is a longitudinal sectional view as seen from the front side of an oil cooled type screw compressor according to Embodiment 7 of the present invention.

FIG. 12 is a longitudinal sectional view as seen from the front side of an oil cooled type screw compressor according to Embodiment 7 of the present invention. FIGS. 13A through 13D are plan views schematically illustrating the external construction of the oil cooled type screw compressor as seen from the front side, left side, right side, and back side, respectively. The oil cooled type screw compressor 106 is equipped with the motor casing 21, the suction side casing 11*b*, the compressor main body casing 11*a*, and the outer cylinder casing 31 which are formed as independent members, and the end portions of these members are fixedly connected together by bolts or the like.

Figure 13A:
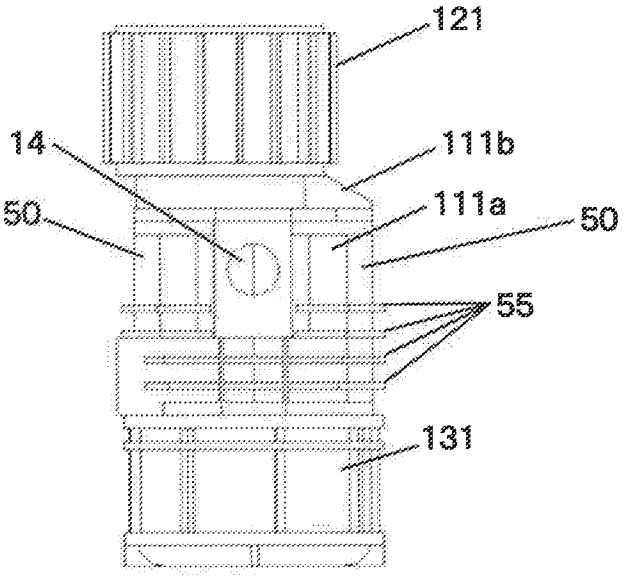
FIG. 13A is a plan view (front side) schematically illustrating the external construction of the oil cooled type screw compressor according to Embodiment 7 of the present invention.
Figure 13B:
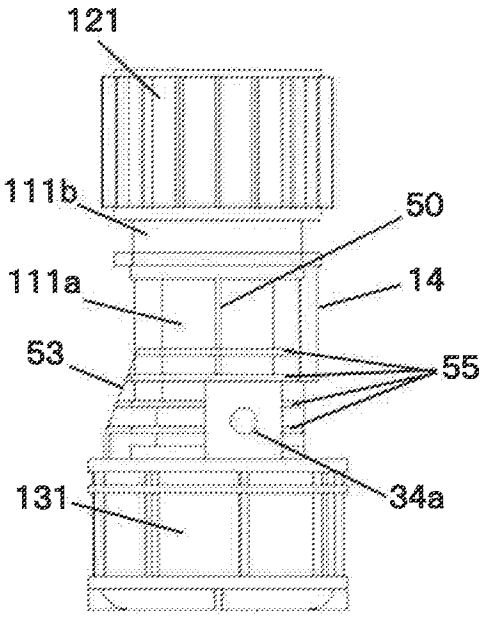
FIG. 13B is a plan view (left side) schematically illustrating the external construction of the oil cooled type screw compressor according to Embodiment 7 of the present invention.
Figure 13C:
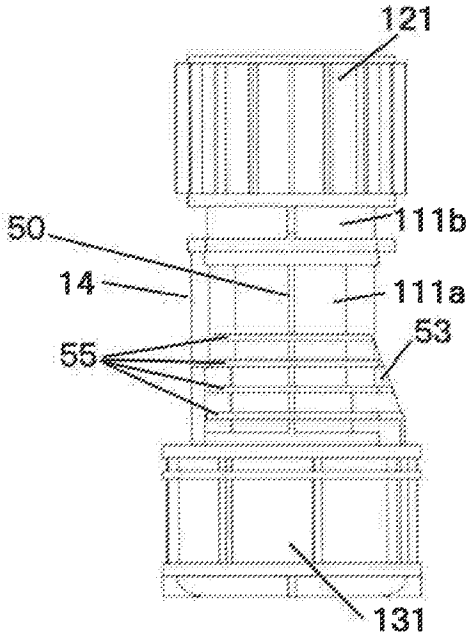
FIG. 13C is a plan view (right side) schematically illustrating the external construction of the oil cooled type screw compressor according to Embodiment 7 of the present invention.
Figure 13D:
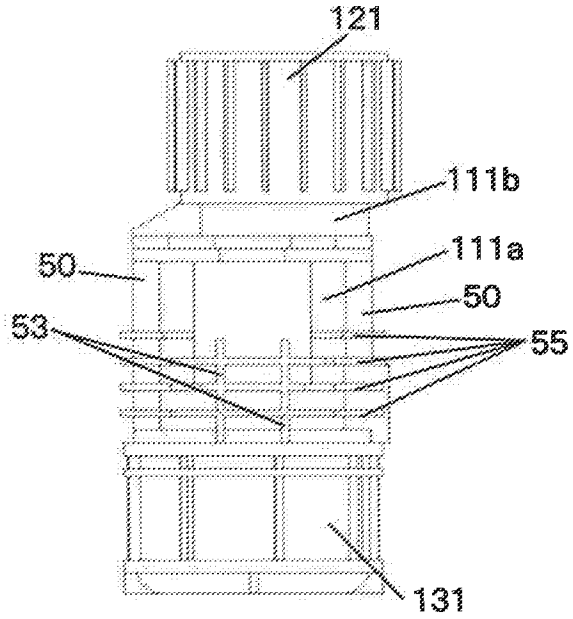
FIG. 13D is a plan view (back side) schematically illustrating the external construction of the oil cooled type screw compressor according to Embodiment 7 of the present invention.

As shown in FIG. 13A, a suction port 14 is arranged in the outer periphery of the front side of the compressor main body casing 11*a*, and as shown in FIG. 13B, a discharge port 34*a* for the compressed air is arranged in the outer periphery of the left side surface. Further, the compressor main body casing 11*a* has a plurality of ribs in the outer periphery other than the suction port and the discharge port 34*a*.

As in the case of Embodiment 5 shown in FIG. 7, the compressor main body casing 11*a* is equipped with vertically extending ribs 50 on the left and right side surfaces of the outer periphery thereof. Further, the compressor main body casing 11*a* is equipped with two vertically extending ribs 53 on the discharge side (downward direction in the figure) of the back surface of the outer periphery thereof (see FIG. 13D). The ribs 53 are of a configuration in which their radial dimensions gradually increase as they extend from the suction side toward the discharge side. Further, the compressor main body casing 11*a* has a plurality of ribs 53 extending along the peripheral surface of the outer periphery.

Figure 14A:
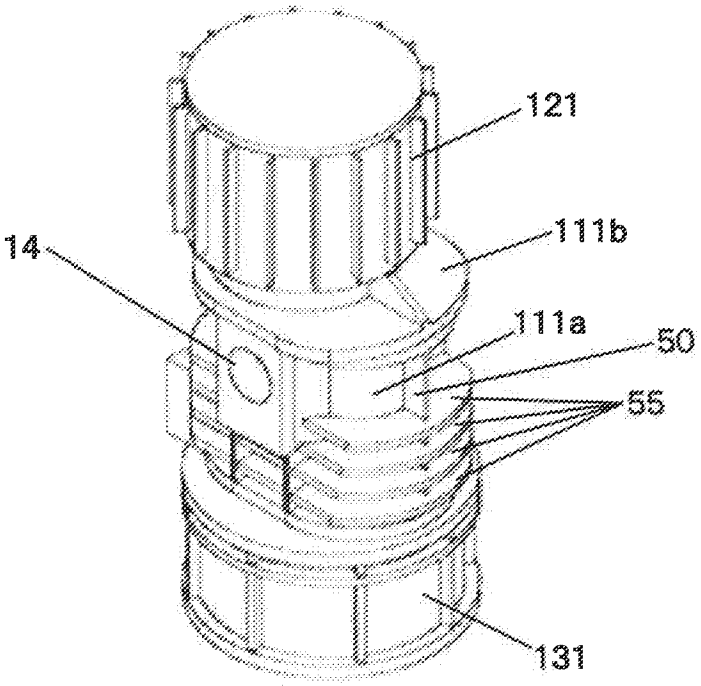
FIG. 14A is a perspective view (front side and right side forward) schematically illustrating the external construction of the oil cooled type screw compressor according to Embodiment 7 of the present invention.
Figure 14B:
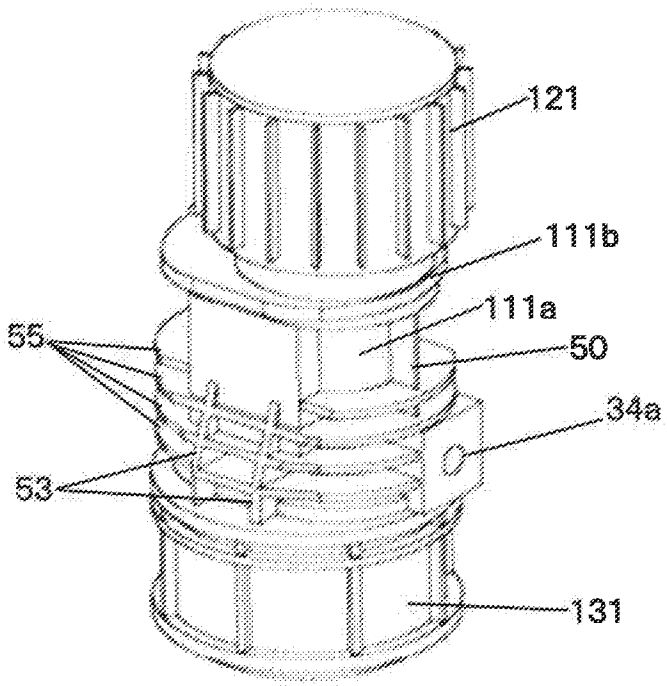
FIG. 14B is a perspective view (back side and left side forward) schematically illustrating the external construction of the oil cooled type screw compressor according to Embodiment 7 of the present invention.

FIGS. 14A and 14B schematically illustrates conceptual perspective views of the compressor main body 10. FIG. 14A is a diagram in which observation is made with the front side surface and right side surface forward. FIG. 14B is a diagram in which observation is made with the back surface and left side surface forward. The ribs 50, ribs 53, and the ribs 55 are configured to be integrally molded with the compressor main body casing 11*a*. However, they may be installed afterwards by welding or the like. Further, these ribs cross each other in the extending direction.

Figure 15A:
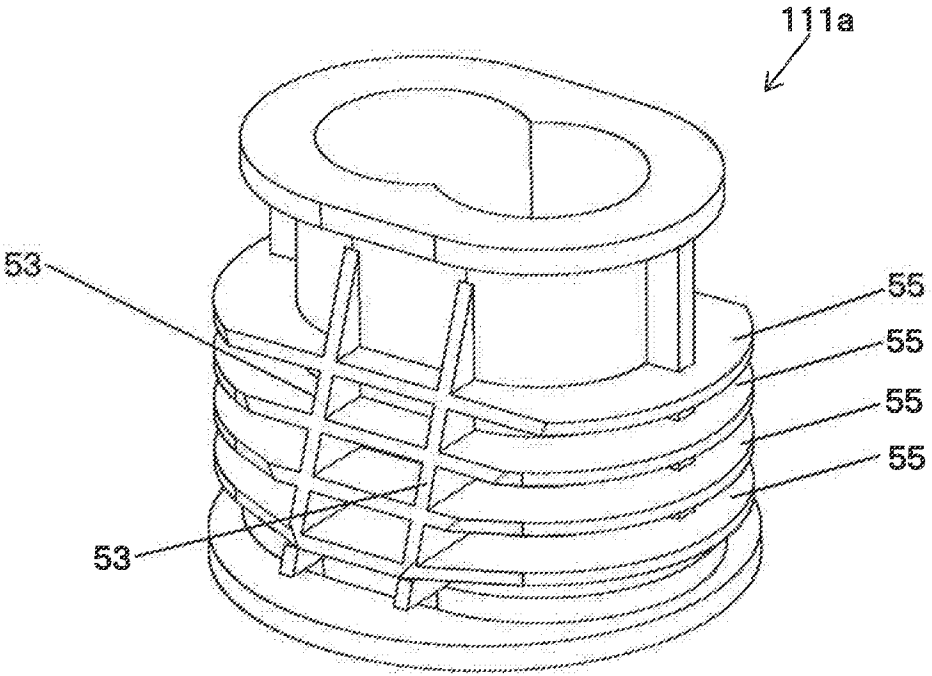
FIG. 15A is a perspective view (back side and left side forward) schematically illustrating the external construction of the compressor main body casing of the oil cooled type screw compressor according to Embodiment 7 of the present invention.
Figure 15B:
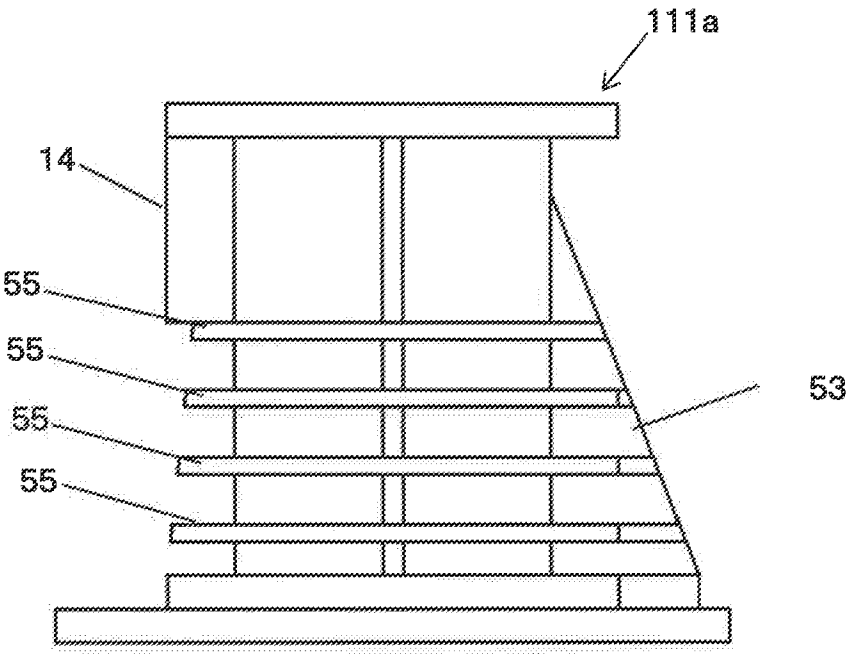
FIG. 15B is a plan view (right side) schematically illustrating the external construction of the compressor main body casing of the oil cooled type screw compressor according to Embodiment 7 of the present invention.

FIGS. 15A and 15B are schematic external views of the compressor main body casing 11*a*. FIG. 15A is a diagram in which observation is made with the back surface and the left side surface of the compressor main body casing 11*a* forward, and FIG. 15B is a diagram in which observation is made from the right side surface. Near the outer periphery of the back surface of the compressor main body casing 11*a*, the plurality of ribs 55 extending in the horizontal direction along the outer peripheral surface are of a configuration in which their extension widths in the horizontal direction gradually increase from the suction side toward the discharge side. Like the ribs 53 extending vertically in the outer periphery of the back surface, the ribs 55 at positions close to the discharge side are also enlarged in the horizontal direction, whereby the rigidity of the compressor main body casing 11*a* with respect to the compression pressure is enhanced, and the vibration insulation and the sound insulation are improved.

Further, in the present embodiment, the horizontal widths of the side surface portion and of the front surface portion of each of the ribs 55 extending in the horizontal direction are substantially the same. The rotor accommodating chamber 12 functioning as the compression operation chamber together with the screw rotors 13A and 13B attains high pressure on the discharge side in the axial direction and near the discharge port 19. In the other regions, however, its pressure is substantially equivalent to the atmospheric pressure. It is therefore advantageous in terms of vibration insulation and sound insulation to enhance the rigidity of the back surface of the outer periphery and the portion near the discharge side of the compressor main body casing 11*a*.

The ribs 50, 53, and 55 also function as radiation fins. Since the higher pressure portions thereof generate more heat, the construction in which the width dimension of the ribs 53 and 55 is enlarged toward the discharge side is also efficient in terms of heat radiation.

In the oil cooled type screw compressor 106 according to Embodiment 7, even in the case where each casing is constructed individually, the ribs 50, 53 and 55 enhance the rigidity and can improve the vibration insulation and the sound insulation. In particular, in the construction in which the motor 20, the compressor main body 10, and the oil separator 30 are arranged vertically from above, the compressor casing 11*a* is an intermediation portion of the structure supporting the motor 20, which is a heavy object, and extending in the vertical direction, and is a portion affected by the compression pressure, so that the load on the portion as a support structure tends to be larger as compared with those on the other casings. In the present embodiment, the rigidity of the compressor casing 11*a* constituting such a high-load portion is enhanced, whereby it is possible to efficiently improve the rigidity, vibration insulation, sound insulation, and cooling of the oil cooled type screw compressor 106.

(Modification)

Although not shown, in Embodiment 7, there is adopted a construction in which each casing is constructed individually and in which the ribs 51, 53, and 55 are arranged. However, as in Embodiment 1, etc., it is also naturally possible to apply the embodiment to the case where a plurality of casings are formed as an integrally-molded single member. In this case, an enhanced effect is to be expected in terms of rigidity, sound insulation, and vibration insulation.

The present invention is not restricted to the above-described various embodiments but includes various modifications. For example, while the above embodiments have been described in detail in order to facilitate the understanding of the present invention, the present invention is not always restricted to what is equipped with all of the above-described construction. Further, it is possible to replace a part of a certain embodiment by the construction of another embodiment, or to add the construction of another embodiment to the construction of a certain embodiment. Further, regarding a part of the construction of each embodiment, the addition, omission, or replacement of some other construction is allowed.

DESCRIPTION OF REFERENCE CHARACTERS

10: Compressor main body
11*a*, 111*a*: Compressor main body casing
11*b*, 111*b*: Suction side casing
11*c*, 11*d*: Discharge side cover
12: Rotor accommodating chamber
13A: Male rotor
13B: Female rotor
14: Suction port
15A, 15B: Suction side bearing
16A, 16B: Discharge side bearing
17A, 17B: Oil sump
18: Suction chamber
19: Discharge port
20: Motor
21, 121: Motor casing
22: Shaft
23A, 23B: Motor rotor
24: Stator
25: End bracket
26: Stator
27: Motor rotor
30: Oil separator
31, 131: Outer cylinder casing
32: Inner cylinder
33: Oil storage portion
34: Discharge piping
34*a*: Discharge port
35: Guide
36: Slope
37: Terminal end portion of the slope
40 through 43: Integral type casing
50, 51, 53, 55: Rib
60: Compressed air flow discharged from the discharge port
61: Compressed air flow along the inner peripheral surface of the outer cylinder casing
62: Flow into the oil separator
100 through 106: Oil cooled type screw compressor
G1: Synthetic center of gravity of the motor and the compressor main body
G2: Center of gravity of the oil separator

The invention claimed is:

1. A liquid feeding type screw compressor comprising:
a compressor main body equipped with a screw rotor;
a motor driving the screw rotor of the compressor main body; and
a gas-liquid separator separating a liquid from a compressed air discharged from the compressor main body, the gas-liquid separator comprising a casing, wherein
a compressor main body casing and the casing of the gas-liquid separator constituting a contour of the gas-liquid separator consist of an integrally-molded single member, and
a synthetic center of gravity of the compressor main body and the motor and a center of gravity of the gas-liquid separator are positioned on the same vertical axis.

2. The liquid feeding type screw compressor according to claim 1, wherein the compressor main body casing and a motor casing constituting a contour of the motor consist of an integrally-molded single member.

3. The liquid feeding type screw compressor according to claim 1, wherein a plurality of vertically extending ribs are provided on an outer peripheral surface of the compressor main body casing and on an outer peripheral surface of the casing constituting the contour of the gas-liquid separator.

4. The liquid feeding type screw compressor according to claim 3, wherein each of the plurality of ribs is of a configuration in which its radial dimensions gradually increases as it extends toward a discharge side of the compressor main body.

5. The liquid feeding type screw compressor according to claim 1, wherein a vertically extending rib is provided on an outer periphery of the compressor main body casing.

6. The liquid feeding type screw compressor according to claim 5, wherein the vertically extending rib is of a configuration in which its radial dimension gradually increases as it extends toward a discharge side of the compressor main body.

7. The liquid feeding type screw compressor according to claim 5, wherein the vertically extending rib is positioned on a portion of the outer periphery of the compressor main body casing, the portion being close to a discharge port through which a compressed air is discharged from the compression operation chamber.

8. The liquid feeding type screw compressor according to claim 1, wherein a plurality of ribs extending in a horizontal direction is provided on and along an outer peripheral surface the compressor main body casing.

9. The liquid feeding type screw compressor according to claim 8, wherein the plurality of ribs are of a configuration in which their horizontal widths gradually increase as they are closer to a discharge side of the compressor main body.

10. The liquid feeding type screw compressor according to claim 9, wherein the plurality of ribs are of a configuration in which their horizontal widths gradually increase on the outer periphery of the compressor main body casing as they are closer to a discharge port through which a compressed air is discharged from the compression operation chamber.

11. The liquid feeding type screw compressor according to claim 1, wherein
a plurality of vertically extending ribs are provided on an outer peripheral surface of the compressor main body casing, and
a plurality of horizontally extending ribs are provided along the outer peripheral surface of the compressor main casing.

12. The liquid feeding type screw compressor according to claim 11, wherein
the plurality of vertically extending ribs are of a configuration in which their radial dimensions gradually increase as they extend toward a discharge side, and
the plurality of horizontally extending ribs are of a configuration in which their horizontal widths gradually increase as they are closer to a discharge side of the compressor main body.

13. The liquid feeding type screw compressor according to claim 11, wherein the plurality of vertically extending ribs and the plurality of horizontally extending ribs cross each other in the outer periphery of the compressor main body casing.

14. The liquid feeding type screw compressor according to claim 1, wherein there are provided a guide deflecting a flow direction of the compressed air discharged from the compressor main body such that the flow direction is along the inner peripheral surface of the casing of the gas-liquid separator, and
a slope deflecting the flow direction of the compressed air discharged from the compressor main body such that the flow direction is close to the horizontal direction.

15. The liquid feeding type screw compressor according to claim 1, wherein an axial direction of a screw of the liquid feeding screw compressor and an axial direction of the motor are vertical.

* * * * *